United States Patent [19]

Kawakami et al.

[11] 3,956,812

[45] May 18, 1976

[54] APPARATUS FOR FEEDING SLIDE FASTENER PARTS

[75] Inventors: Koichi Kawakami, Kurobe; Tatsuo Osaki, Uozu, both of Japan

[73] Assignee: Yoshida Kogyo Kabushiki Kaisha, Japan

[22] Filed: Apr. 17, 1974

[21] Appl. No.: 461,628

[30] Foreign Application Priority Data

Apr. 18, 1973 Japan ..... 48-43870

[52] U.S. Cl. ..... 29/207.5 SL; 29/211 R; 193/2 A; 193/25 FT

[51] Int. Cl.[2] ..... B21D 53/50

[58] Field of Search ..... 29/207.5 SL, 207.5 ST, 29/211 R, 207.5 R; 193/2 A, 2 R, 2 D, 25 FT, 25 C

[56] References Cited

UNITED STATES PATENTS

| | | | |
|---|---|---|---|
| 2,825,126 | 3/1958 | Legat et al. | 29/207.5 SL |
| 2,949,666 | 8/1960 | Rogers et al. | 29/211 R |
| 3,002,600 | 10/1961 | Campbell | 193/25 FT |
| 3,054,170 | 9/1962 | Benichasa et al. | 29/211 R |
| 3,107,767 | 10/1963 | Medoff et al. | 193/25 FT |
| 3,663,000 | 5/1972 | Perlman | 29/207.5 SL |

*Primary Examiner*—Victor A. Di Palma
*Attorney, Agent, or Firm*—Bucknam and Archer

[57] ABSTRACT

Apparatus is disclosed for feeding slide fastener parts from a parts feeder to a parts assembling station, which apparatus is characterized by the provision of linking means for removably connecting a part feed chute between the feeder and the station. The linking means comprise a first chute holder connected to the parts feeder and a second chute holder connected to the assembling station, the first holder having spring-loaded grippers adapted to come into and out of locking engagement with one end fitting of the chute, and the second holder having a spring-loaded positioning pin adapted to lock the other end fitting of the chute into position relative to the second holder.

6 Claims, 8 Drawing Figures

FIG. 1
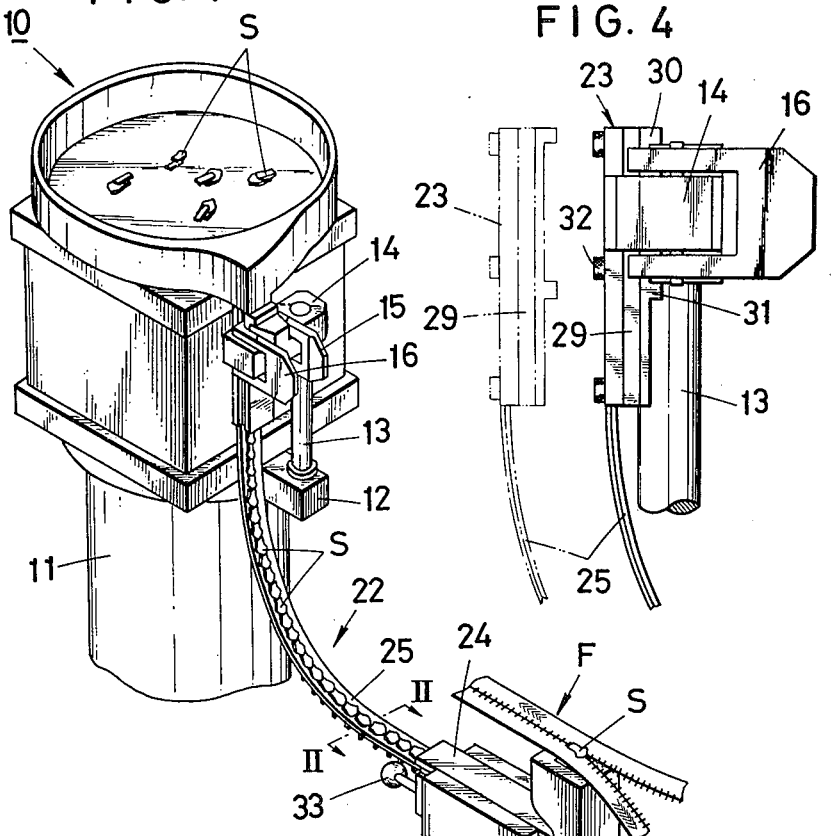
FIG. 4
FIG. 2
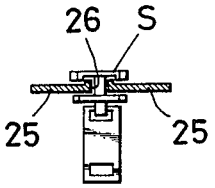
FIG. 3
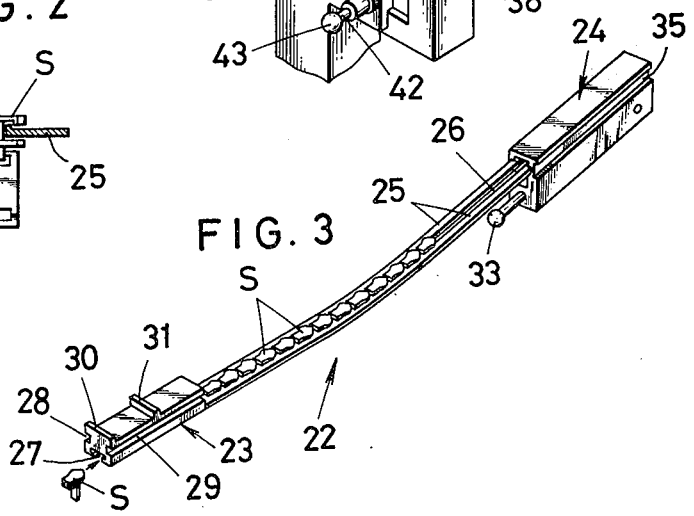

APPARATUS FOR FEEDING SLIDE FASTENER PARTS

BACKGROUND OF THE INVENTION

This invention relates to apparatus for feeding slide fastener parts to be assembled on a slide fastener chain.

The apparatus concerned usually comprises a parts feeder containing a supply of slide fastener parts such as sliders and end stops and a feeding chute connected thereto for delivering successive parts to an assembling station wherein the parts are assembled on a fastener chain. However, such apparatus in the conventional practice has suffered from the difficulties that when changes in the type or color of assembling parts are desired, it is necessary to remove the chute or to retract the operative units at the outlet end of the chute, with added time-consuming operation to re-position the chute.

SUMMARY OF THE INVENTION

It is therefore an object of the present invention to provide novel mechanism for feeding slide fastener parts from a supply source to an assembling station, which mechanism includes linking means connecting a feeding chute removably between the supply source and the assembling station, whereby the chute can be readily removed and mounted in position with a minimum of time and effort.

This object together with other features of the invention will be more apparent from the following description taken in conjunction with the accompanying drawings which illustrate by way of example only a preferred embodiment which the invention assumes in practice.

BRIEF DESCRIPTION OF THE DRAWINGS

FIG. 1 is a perspective view of an overall equipment arrangement provided in accordance with the invention;

FIG. 2 is a transverse cross-sectional view taken on the line II—II of FIG. 1;

FIG. 3 is a perspective view of a chute unit incorporating the features of the invention;

FIG. 4 is a side elevation of connecting parts between one end of the chute unit and a parts feeder;

DESCRIPTION OF THE PREFERRED EMBODIMENT

Figure 5:
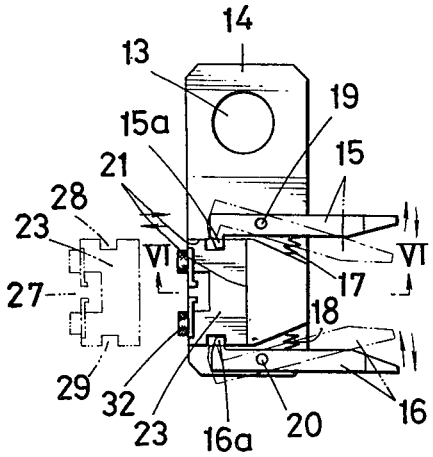
FIG. 5 is a plan view of said connecting parts.

Referring now to the drawings and FIG. 1 in particular, there is shown a parts feeder 10 such as in the form of a vibrating hopper containing a supply of slide fastener parts; that is, sliders S in the illustrated embodiment and mounted on a support cradle 11 at an elevated position. Projecting horizontally from the support cradle 11 is a lug 12 adapted to support thereon one end of a supporting post 13. Mounted on the other end of the post 13 and extending at right angles thereto is a first chute holder 14 which is adapted to removably hold one end of a parts feed chute later described.

Figure 6:
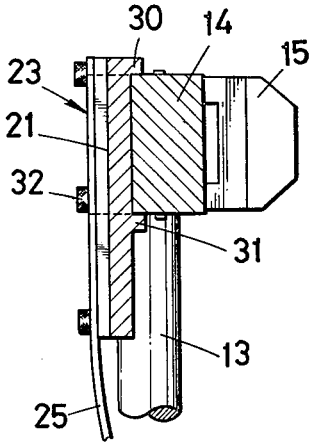
FIG. 6 is a sectional view taken on the line VI—VI of FIG. 5.
Figure 7:
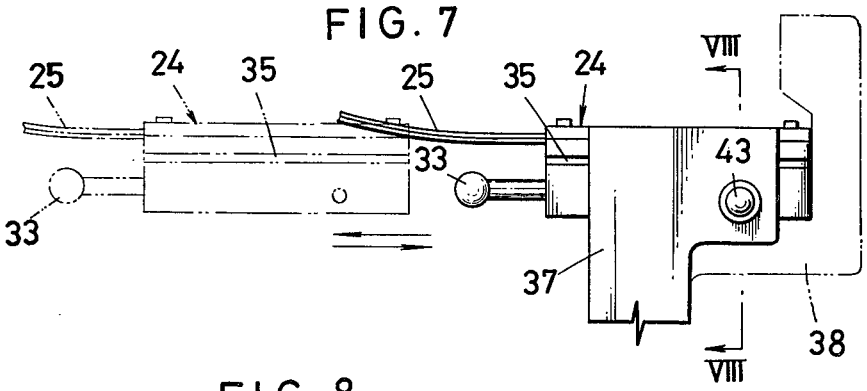
FIG. 7 is a side elevation of connecting parts between the other end of the chute unit and a parts holder.

The first chute holder 14, as better seen in FIGS. 4 through 6 inclusive, is provided with a pair of grippers

15,16 having inwardly directed bifurcated clamping claws **15*a*,16*a* at one end which are normally urged inwardly toward each other by spring members 17,18 respectively, for which purpose the grippers 15,16 are pivotally connected by pins 19,20 respectively to the chute holder 14. There is provided a recess 21 in the first chute holder 14, which recess opens towards the parts feeder 10** and is configured to fit snugly with a chute bracket hereafter described.

A parts feed chute or track 22 as best shown in FIG. 3, is provided with a first end fitting or chute support bracket 23 adapted to releasably join one end of the chute 22 to the first chute holder 14 and with a second end fitting or chute support box 24 adapted to releasably join the other end of the chute 22 to a second chute holder hereafter described. The feed chute 22 comprises spaced parallel rails 25 along which sliders S are transported by gravity and which are separated by a slot 26 through which the pull tabs of the sliders depend as seen in FIGS. 1 and 2.

The chute support bracket 23 attached as by threaded bolts 32 to one end of the chute 22 is provided with a longitudinal channel 27 in the lower surface thereof, which channel communicates with the slot 26 in a manner to permit the sliders S to move unobstructedly through the chute bracket 23. The chute bracket 23 is also provided with side grooves 28,29 which are adapted to receive the claws **15*a*,16*a* respectively when the bracket 23 is fitted into the recess 21 of the first chute holder 14. On the upper surface of the chute bracket 23 are provided ridges 30,31 extending transversely in spaced parallel relation, which ridges are adapted to hold the chute holder 14 therebetween as best shown in FIG. 6**.

Figure 8:
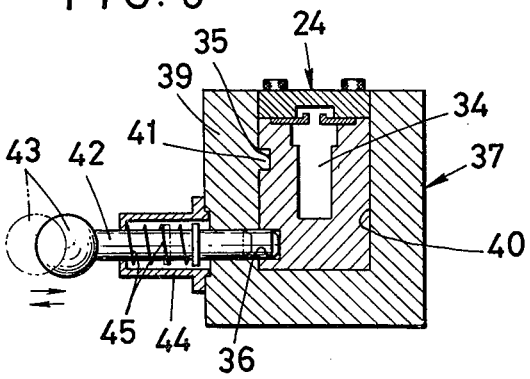
FIG. 8 is a sectional view taken on the line VIII—VIII of FIG. 7.

The chute support box 24 secured to the other end of the chute 22 includes a pull knob 33 extending longitudinally towards the chute bracket 23 and adapted to facilitate removal of the box 24 from a second chute holder. As best shown in FIG. 8, the chute box 24 is provided interiorly with a guide channel 34 for the passage of sliders S, which channel is deep enough to allow the slider pull tabs to depend freely therethrough. For stable mounting and correct positioning of the chute in a second chute holder, the chute support box 24 is provided in one side wall thereof with a longitudinal guide groove 35 and a pin-receiving hole 36 at a predetermined position below the groove 35.

There is provided a second chute holder 37 immediately adjacent a parts assembling device such as a slider holder 38 as in the illustrated embodiment. The second chute holder 37 is adapted to connect the feed chute 22 to the slider holder 38 so as to feed sliders S from the parts feeder 10 to the slider holder 38. The second chute holder 37 comprises a cross-sectionally U-shaped block 39 having a longitudinal aperture 40 dimensioned to receive the chute box 24 snugly therein. The chute holder 37 is provided with a longitudinal guide wale 41 projecting inwardly into the aperture 40 and positioned in registry with the longitudinal guide groove 35 of the chute box 24. The chute holder 37 further includes a positioning pin 42 having a knob 43 and supported in a sleeve 44. This positioning pin 42 is normally urged by spring 45 in a direction to extend into the aperture 40 and positioned to come into engagement with the pin-receiving hole 36 of the chute box 24.

The operation of the apparatus will now be described with regard to mounting the feed chute 22 in position between the parts feeder 10 and the parts holder 38. The clamping claws 15*a*,16*a* of the respective grippers 15,16 are retracted from the recess 21 of the first chute holder 14 by moving the free ends of the grippers 15,16 inwardly towards each other as indicated by chain-dot line in FIG. 5. Into the thus cleared recess 21 is inserted the chute bracket 23 from behind the chute holder 14 as shown in FIGS. 4 and 5, when this holder is fitted snugly between the opposed transverse ridges 30,31 of the chute bracket 23. The grippers 15,16 are now released so that the clamping claws 15*a*,16*a* are biased towards each other by the action of the springs 17,18 and snapped into locking engagement with the side grooves 28,29 as indicated by solid line in FIG. 5. It is to be noted here that the side grooves 28,29, the ridges 30,31 and the clamping claws 15*a*,16*a* function together in positioning the chute bracket 23 relative to the chute holder 14. After the feed chute 22 has been thus connected at one end to the parts feeder 10, the chute 22 is flexed along the line of path of sliders S so as to bring the chute box 24 at the other end into alignment with the second chute holder 37, for which purpose the rails 25 should be made preferably of somewhat elastic materials. The positioning pin 42 is pulled clear out of the aperture 40 in the second chute holder 37 as indicated by chain-dot line in FIG. 8, whereupon the chute box 24 is slid into the aperture 40 with the longitudinal guide groove 35 of the box 24 registered with the longitudinal guide wale 41 of the holder 37. The chute box 24 is thus inserted until the pin-receiving hole 36 comes into registry with the position of the pin 42, when this pin is released and brought into locking engagement with the hole 36 by the action of the spring 45. In this instance, the longitudinal guide groove 35, the longitudinal guide wale 41 and the pin 42 serve together in holding the chute box 24 in correct position relative to the chute holder 37. The operation is reversed when removing the parts feed chute 22.

Designated by the reference character F in FIG. 1 is a slide fastener chain to which a slider S is assembled in the well known manner.

While the apparatus according to this invention has been shown and described hereinbefore in terms of the specific embodiment thereof, it is to be understood that the invention itself is not to be restricted by the exact showing of the drawings or the description thereof but is considered to include other examples coming within the spirit and scope of the following claims.

We claim:

1. Apparatus for feeding slide fastener sliders which comprises a feed chute comprising spaced parallel rails, first chute holding means provided at a parts feeder, a first end fitting secured to one end of said chute and removably connected to said first chute holding means, second chute holding means provided at a parts applying station, a second end fitting secured to the other end of said chute and removably connected to said second chute holding means, and positioning means adapted to retain said first and second end fittings in position relative to said first and second chute holding means, respectively said first chute holding means including releaseable grippers biased for engagement with corresponding surfaces on said first end fitting to establish connection thereof to said first chute holding means, and said second chute holding means including a releaseable member biased for engagement with a corresponding surface on said second end fitting to establish connection thereof to said second chute holding means.

2. Apparatus for feeding slide fastener parts such as sliders which comprises a feed chute comprising spaced parallel rails along which the fastener parts are delivered, a first end fitting secured to one end of said feed chute and having longitudinal side grooves, first chute holding means having a recess configured to fit with said first end fitting and a pair of spring-loaded grippers adapted to come into and out of engagement with said longitudinal side grooves, a second end fitting secured to the other end of said feed chute and having a longitudinal guide groove and a pin-receiving hole, and second chute holding means having an aperture configured to fit with said second end fitting, a longitudinal guide wale disposed for sliding engagement with said longitudinal guide groove and a spring-loaded positioning pin adapted to come into and out of locking engagement with said pin-receiving hole.

3. Apparatus as claimed in claim 2 wherein said spring-loaded grippers are pivotally connected to said first chute holding means and are provided at one ends thereof with inwardly directed bifurcated clamping claws for locking engagement with said longitudinal side grooves.

4. Apparatus as claimed in claim 2 wherein said second end fitting is provided with a pull knob adapted to facilitate removal of this end fitting from said second chute holding means.

5. Apparatus as claimed in claim 2 wherein said first chute holding means is connected to a parts feeder containing a supply of slide fastener parts.

6. Apparatus as claimed in claim 2 wherein said second chute holding means is connected to a parts holder for applying slide fastener parts to a slide fastener chain.

* * * * *